US010293194B2

(12) United States Patent
Twu et al.

(10) Patent No.: US 10,293,194 B2
(45) Date of Patent: May 21, 2019

(54) MASK

(71) Applicant: Euclid Technology Co., Ltd, Taoyuan (TW)

(72) Inventors: Ching-Sheng Twu, Taoyuan (TW); Cheng-Huang Lan, Taoyuan (TW); Fang-Yu Tu, Taoyuan (TW); Hsiao-Ying Peng, Taoyuan (TW)

(73) Assignee: EUCLID TECHNOLOGY CO., LTD, Taoyuan (TW)

( * ) Notice: Subject to any disclaimer, the term of this patent is extended or adjusted under 35 U.S.C. 154(b) by 854 days.

(21) Appl. No.: 14/814,628

(22) Filed: Jul. 31, 2015

(65) Prior Publication Data

US 2016/0030779 A1 Feb. 4, 2016

(30) Foreign Application Priority Data

Aug. 1, 2014 (TW) ..... 103213751 U

(51) Int. Cl.

| | |
|---|---|
| ***A62B 18/02*** | (2006.01) |
| ***A62B 7/10*** | (2006.01) |
| ***A62B 18/00*** | (2006.01) |
| *A62B 18/08* | (2006.01) |

(52) U.S. Cl.

CPC ..... *A62B 18/02* (2013.01); *A62B 7/10* (2013.01); *A62B 18/006* (2013.01); *A62B 18/082* (2013.01)

(58) Field of Classification Search

CPC ..... A62B 18/02; A62B 18/045; A62B 18/006; A62B 7/10; A62B 18/00; A41D 13/11; A42B 3/286

USPC ..... 128/205.12

See application file for complete search history.

(56) References Cited

U.S. PATENT DOCUMENTS 4,549,542 A * 10/1985 Chien ..... A62B 18/045 128/201.24
5,035,239 A * 7/1991 Edwards ..... A62B 9/006 128/200.28
5,054,479 A * 10/1991 Yelland ..... A61F 9/02 128/201.24

(Continued)

FOREIGN PATENT DOCUMENTS

KR 20130063287 A * 6/2013 ..... A62B 7/10

OTHER PUBLICATIONS

English Translation of "KR101404760", https://worldwide.espacenet.com, Oct. 30, 2018.*

*Primary Examiner* — Jan Christopher L Merene
*Assistant Examiner* — Cana A Gallegos
(74) *Attorney, Agent, or Firm* — Maschoff Brennan

(57) ABSTRACT

A mask includes a cover body, a first fan, a second fan and an air filter. The cover body has an air inlet and an air outlet penetrating through the cover body. The first fan is disposed on the cover body and matches the air inlet. The second fan is disposed on the cover body and matches the air outlet. The air filter is disposed on the cover body and partially overlaps the air inlet. The first fan drives an air-flow to rapidly flow from the atmosphere into the mask through the air inlet and the air filter. The air filter removes the particulates and the harmful substances in the air-flow. The second fan drives the respiratory gas to rapidly flow from the mask to the atmosphere through the air outlet. Therefore, the user is able to breathe comfortably with non-particulate and clean air.

8 Claims, 7 Drawing Sheets

(56) References Cited

U.S. PATENT DOCUMENTS

| | | | | | |
|---|---|---|---|---|---|
| 5,054,480 | A * | 10/1991 | Bare | A41D 13/11 | 128/201.25 |
| 5,533,500 | A * | 7/1996 | Her-Mou | A42B 3/288 | 128/201.24 |
| 7,178,931 | B1 * | 2/2007 | Murphy | A62B 18/08 | 2/410 |
| 9,827,723 | B2 * | 11/2017 | Klockseth | A62B 18/02 | |
| 2006/0213523 | A1 * | 9/2006 | VanDerWoude | A41D 13/0025 | 128/863 |
| 2010/0065058 | A1 * | 3/2010 | Ungar | A62B 18/02 | 128/206.24 |
| 2013/0102916 | A1 * | 4/2013 | Colbaugh | A61M 16/0816 | 600/533 |

* cited by examiner

MASK

CROSS-REFERENCE TO RELATED APPLICATIONS

This non-provisional application claims priority under 35 U.S.C. § 119(a) on Patent Application No(s). 103213751 filed in Taiwan, R.O.C. on Aug. 1, 2014, the entire contents of which are hereby incorporated by reference.

TECHNICAL FIELD

The disclosure relates to a mask, more particularly to a mask having a fan and an air filter.

BACKGROUND

Air pollution is the introduction of particulates, biological molecules, or other harmful materials into the atmosphere, possibly causing diseases or death to humans. In addition to the particulates being harmful to humans, the atmosphere also contains some particulates possibly causing allergies in some specific areas, such as pollen and salts.

Of all the different kinds of air pollutions, smog is the most difficult one to avoid. The smog indicates dust existing in the atmosphere. If a person inhales the smog, it may cause cardiopulmonary diseases. Furthermore, the smog may decrease the visibility of the surrounding environment, thereby increasing the possibility of causing traffic accidents.

To prevent humans from the particulates in the atmosphere, the simplest way is to wear a mask. However, a common mask is difficult to effectively avoid inhaling the particulates. Therefore, some manufacturers install a filter on the mask, yet the filter obstructs the respiration of user, thereby causing the user to feel uncomfortable.

SUMMARY

According to an embodiment of the disclosure, a mask comprises a cover body, at least one first fan, at least one second fan and an air filter. The cover body has at least one air inlet and at least one air outlet. The at least one air inlet and the at least one air outlet penetrate through the cover body. The at least one first fan is disposed on the cover body and corresponds to the at least one air inlet. The at least one second fan is disposed on the cover body and corresponds to the at least one air outlet. The air filter is disposed on the cover body and partially overlaps the at least one air inlet.

BRIEF DESCRIPTION OF THE DRAWINGS

The present disclosure will become more fully understood from the detailed description given herein below, along with the accompanying drawings which are for illustration only, thus are not limitative of the present disclosure, and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
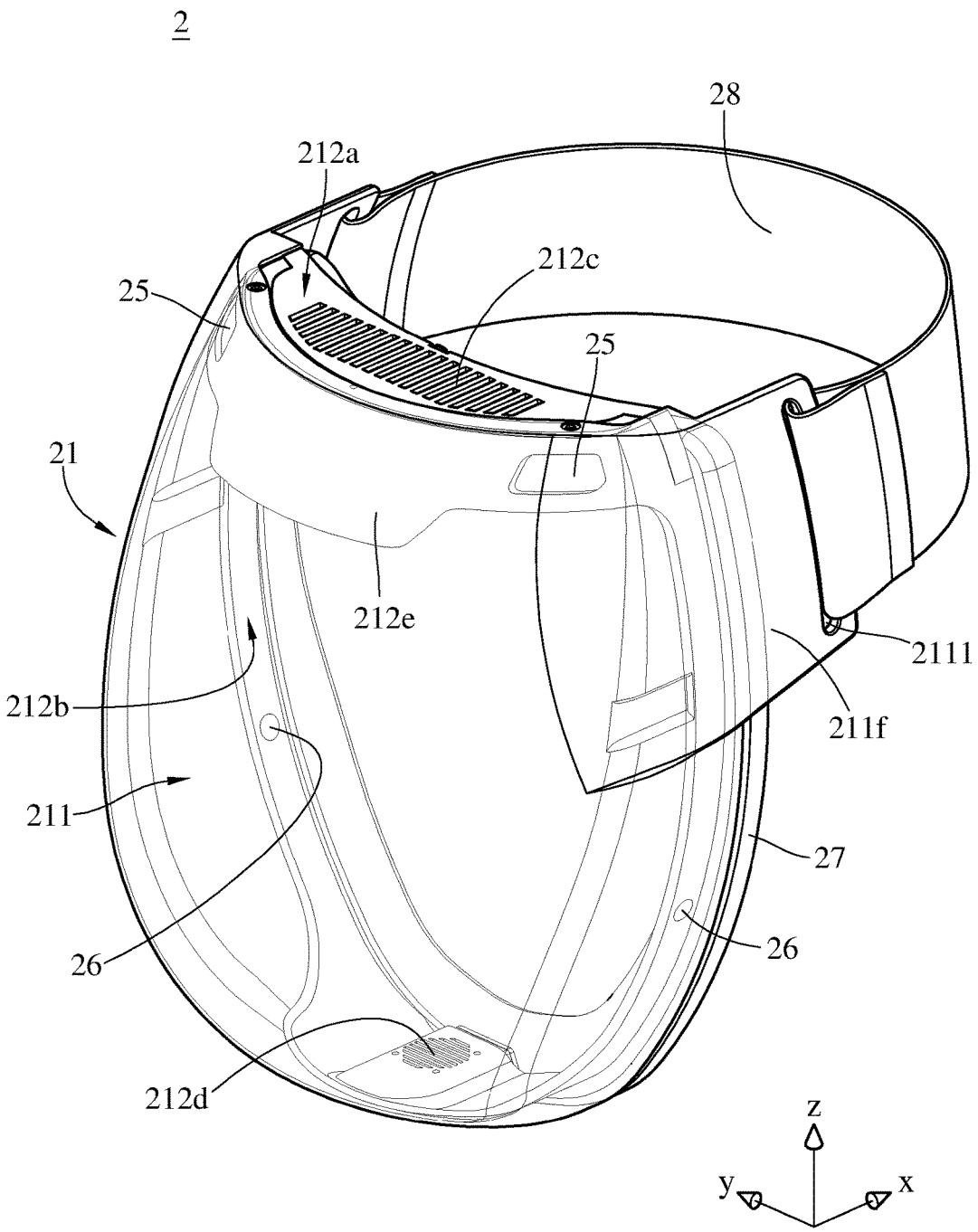
FIG. 1 is a perspective front view of a mask according to an embodiment of the disclosure.
Figure 2:
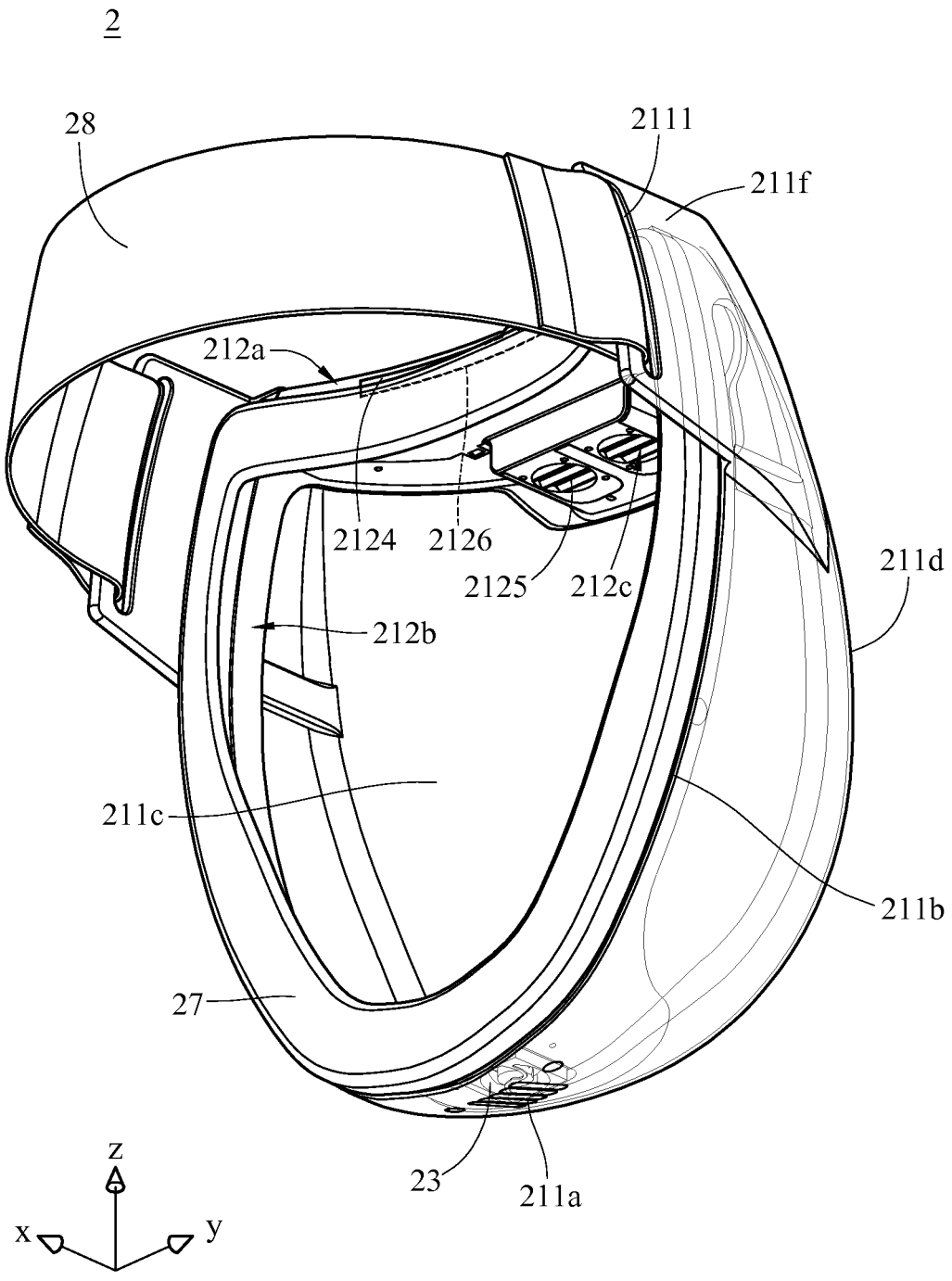
FIG. 2 is perspective rear view of the mask according to the embodiment of FIG. 1.
Figure 3:
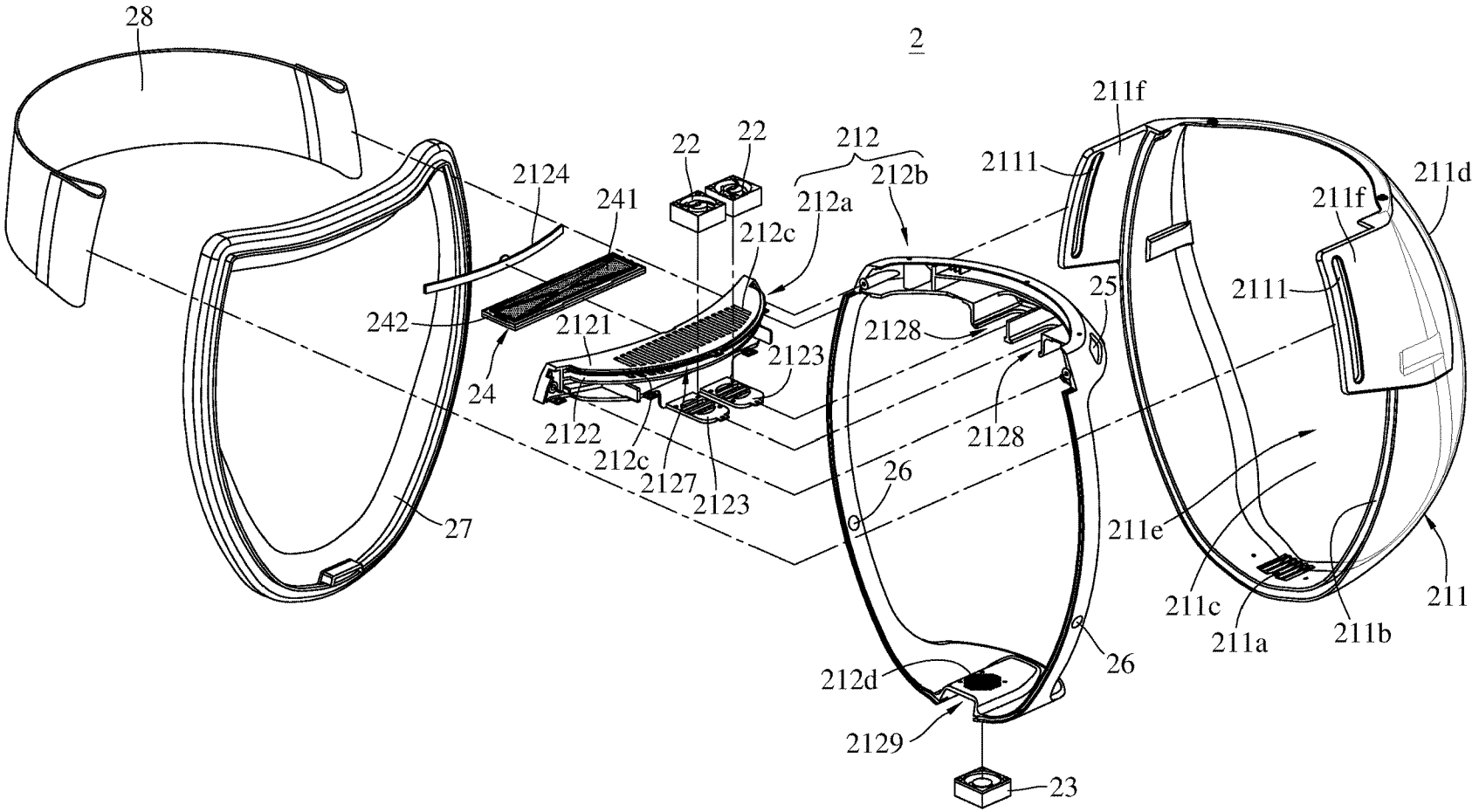
FIG. 3 is an exploded view of the mask according to the embodiment of FIG. 1.

FIG. 1 is a perspective front view of a mask according to a embodiment; FIG. 2 is a perspective rear view of the mask according to the embodiment. FIG. 3 is an explosive view of the mask according to the embodiment. In this embodiment, a mask 2 comprises a cover body 21, two first fans 22, a second fan 23, and an air filter 24.

The cover body 21 comprises a cover shield 211 and a side frame 212. The cover shield 211 has a plurality of air outlets 211*a*, a shield edge 211*b*, a concave surface 211*c* and a convex surface 211*d*. The side frame 212 comprises an assembling component 212*a* and a encircled frame component 212*b*, and has a plurality of air inlets 212*c* and a plurality of air outlets 212*d*. The concave surface 211*c* and the convex surface 211*d* are locate at two sides of the cover shield 211 opposite to each other. The concave surface 211*c* and the shield edge 211*b* together form a covering space 211*e*. The assembling component 212*a* is disposed on the encircled frame component 212*b*. The encircled frame component 212*b* is disposed on the concave surface 211*c*, and the encircled frame component 212*b* is surrounded by the shield edge 211*b*. The air outlets 211*a* of the cover shield 211 are formed in the cover shield 211 and extend through two sides of the cover shield 211. The air inlets 212*c* of the side frame 212 are formed in the assembling component 212*a*, and the air outlets 212*d* of the side frame 212 are formed in the encircled frame component 212*b* and extend through two sides of the encircled frame component 212*b*. The cover shield 211 is partially made of light-transmissive material such as glass and transparent plastic.

In this embodiment, the air inlets 212*c* are located at the top of the cover body 21, and the air outlets 211*a* and the air outlets 212*d* are located at the bottom of the cover body 21, wherein the top of the cover body 21 and the bottom of the cover body 21 are opposite to each other, but the disclosure is not limited thereto. In some other embodiments, the air inlets 212*c*, the air outlets 211*a* and the air outlets 212*d* are located at other positions of the cover body 21. In this embodiment, the number of the air inlets 212*c*, air outlets 211*a* and that of the air outlets 212*d* are all more than one, but the disclosure is not limited thereto. In some other embodiments, the number of the air inlets 212*c*, air outlets 211*a* and that of the air outlets 212*d* are all one.

Figure 4:
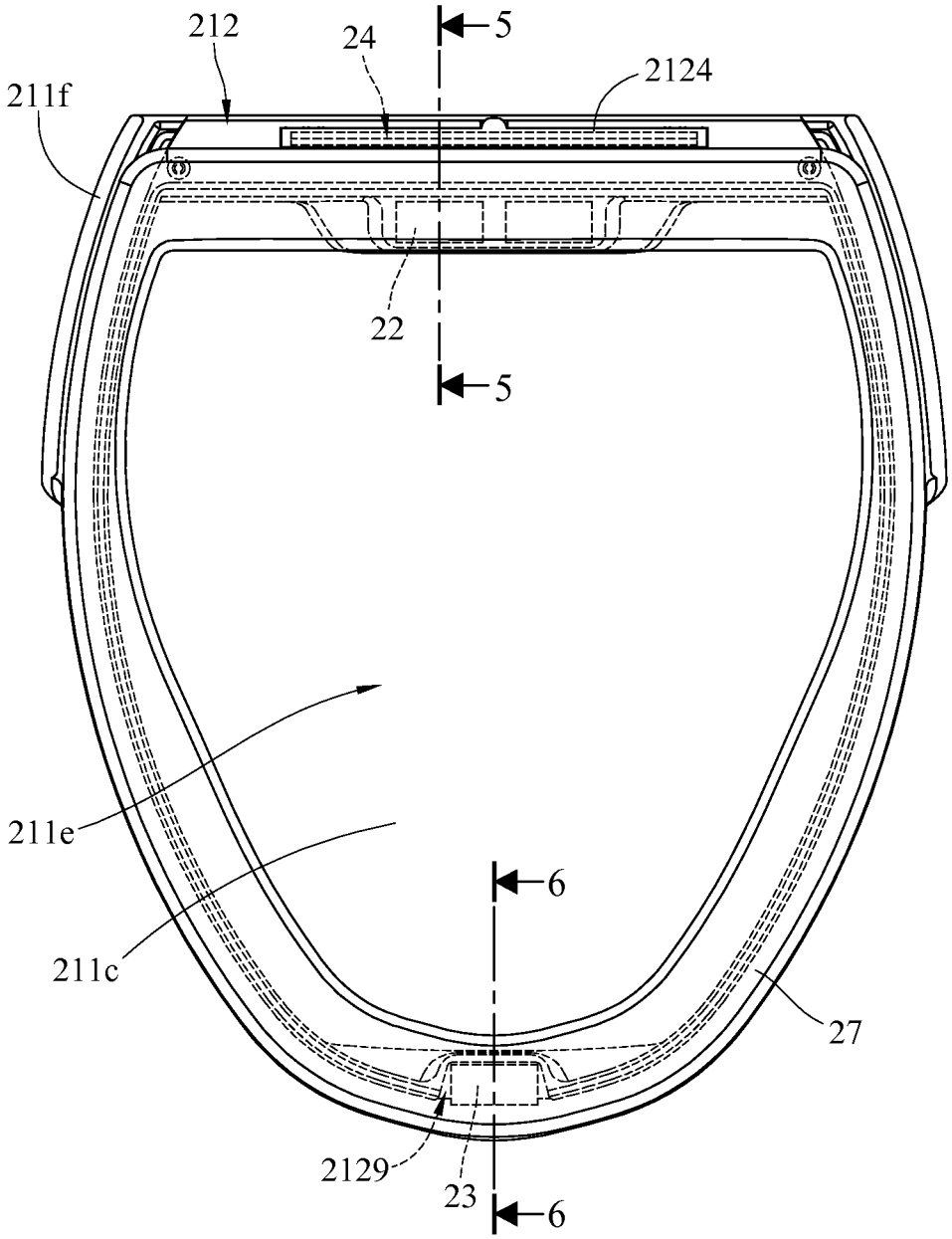
FIG. 4 is a rear view of the mask according to the embodiment of FIG. 1.
Figure 5:
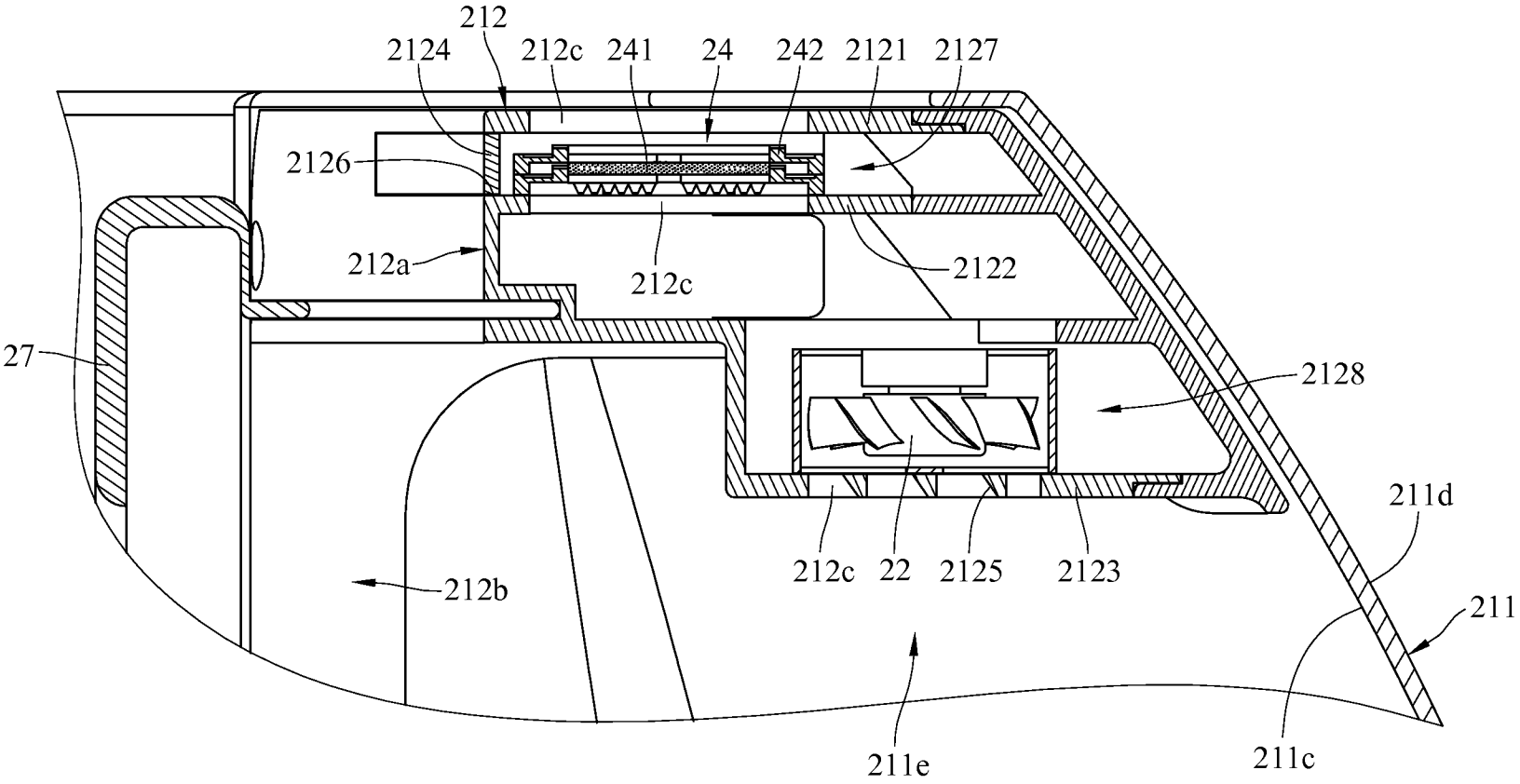
FIG. 5 is a cross-sectional view of the mask along a line 5-5 in FIG. 4.
Figure 6:
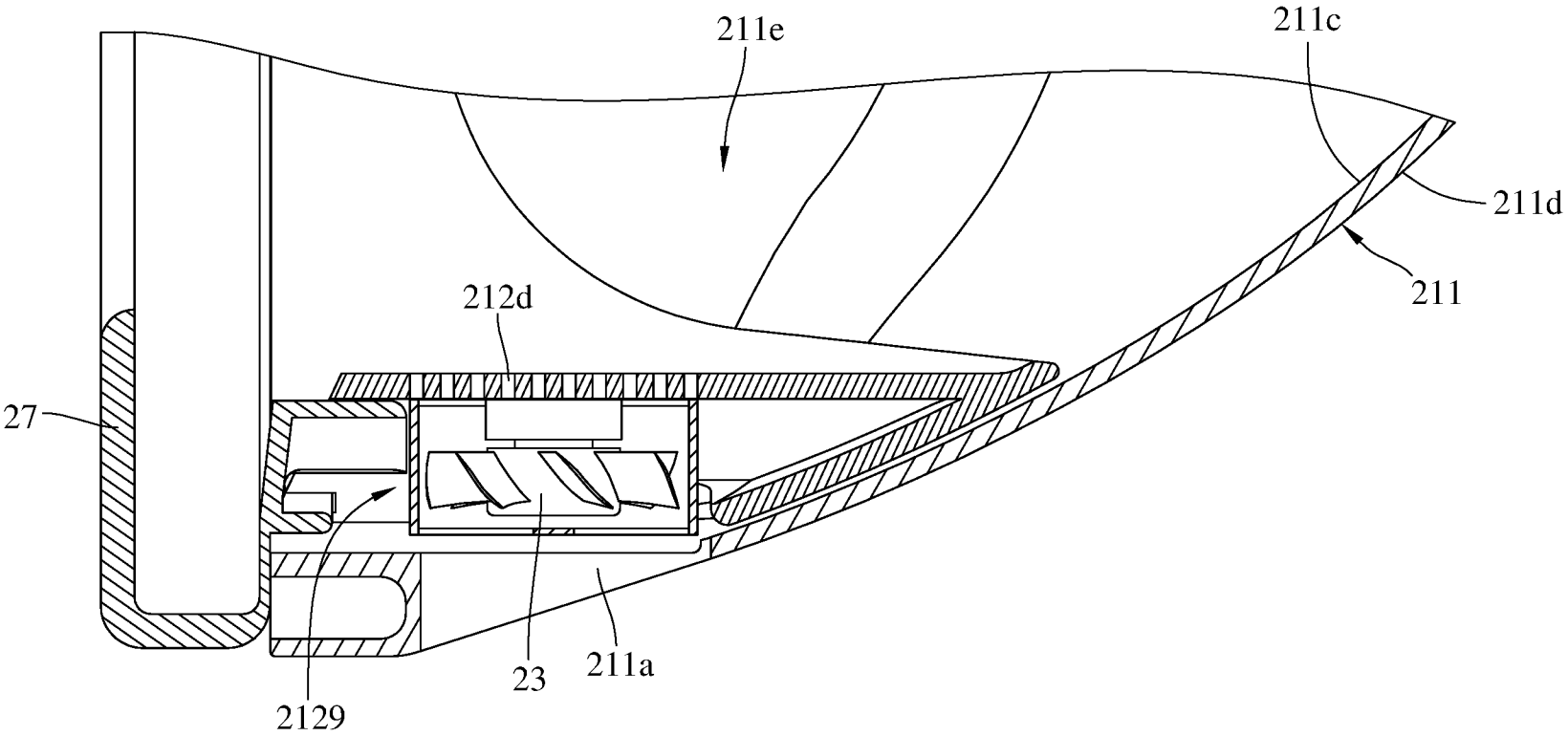
FIG. 6 is a cross-sectional view of the mask along a line 6-6 in FIG. 4.

The following further describes the detail of the side frame. Please refer to FIG. 3, FIG. 4, FIG. 5, and FIG. 6. FIG. 4 is a rear view of the mask according to the embodiment of FIG. 1. FIG. 5 is a cross-sectional view of the mask along a line 5-5 in FIG. 4. FIG. 6 is a cross-sectional view of the mask along a line 6-6 in FIG. 4.

The assembling component 212*a* comprises a first splint 2121, a second splint 2122, two protecting cases 2123, a covering board 2124 and a plurality of deflectors 2125. The assembling component 212*a* has an opening 2126 and an accommodation space 2127. The encircled frame component 212*b* has two first fan notches 2128 and a second fan notch 2129. The first splint 2121, the second splint 2122 and the two protecting cases 2123 are assembled together. The second splint 2122 is located between the first splint 2121 and the two protecting cases 2123. The accommodation space 2127 is formed between the first splint 2121 and the second splint 2122. The opening 2126 is formed between the first splint 2121 and the second splint 2122 and connected to the accommodation space 2127. The covering board 2124 is located at and covers the opening 2126. The two protecting cases 2123 cover the two first fan notches 2128, respectively, so that the two first fan notches 2128 are both disposed between the second splint 2122 and the two protecting cases 2123. The air inlets 212*c* are formed in the first splint 2121, the second splint 2122 and the two protecting cases 2123 so as to connect the accommodation space 2127 and the two first fan notches 2128. The air outlets 211*a* are formed in the cover shield 211 so as to connect the second fan notch 2129 and outside atmosphere, and the air outlets 212*d* are formed in the encircled frame component 212*b* so connect the second fan notch 2129 and the covering space 211*e*. The deflectors 2125 are located inside the air inlets 212*c* which are formed in the two protecting cases 2123.

The two first fans 22 are located in the two first fan notches 2128, respectively. The two first fans 22 partially overlap the air inlets 212*c* formed in the two protecting cases 2123. In this embodiment, the number of the first fans 22, the first fan notches 2128 and that of the protecting cases 2123 are all two, but the disclosure is not limited thereto. In some other embodiments, the number of the first fans 22, the first fan notches 2128 and that of the protecting cases 2123 are one.

The second fan 23 is located in the second fan notch 2129, and partially overlaps the air outlets 211*a* and the air outlet 212*d*. In this embodiment, the number of the second fan 23 and that of the second fan notch 2129 are both one, but the disclosure is not limited thereto. In some other embodiments, the number of the second fan 23 and that of the second fan notch 2129 are more than one.

The air filter 24 is, for example, a High-Efficiency Particulate Air (HEPA) filter or an activated carbon filter leaf. The air filter 24 is located in the accommodation space 2127, and partially overlaps the air inlets 212*c* formed in the first splint 2121 and the second splint 2122. In this embodiment, the air filter 24 comprises a filtering core 241 and a rack 242, wherein the rack 242 clamps the filtering core 241, but the disclosure is not limited thereto. In some other embodiments, the air filter 24 does not comprise the rack 242.

Please refer to FIG. 1 and FIG. 2 again. The mask 2 further comprises a first light source 25 and a second light source 26. The encircled frame component 212*b* further has an extending part 212*e* extending along the concave surface 211*c* from the shield edge 211*b* to a center of the concave surface 211*c*, and a frame inner surface 212*f* facing towards the concave surface 211*c*. Both of the first light source 25 and the second light source 26 are, for example, a light-emitting diode (LED) or a lamp. The first light source 25 is disposed on one side of the extending part 212*e* facing towards the concave surface 211*c*. In other words, the first light source 25 is able to illuminate from the concave surface 211*c* to the convex surface 211*d* through the cover shield 211. The second light source 26 is disposed on the side frame inside surface 212*e*.

Furthermore, the mask 2 further comprises an annular elastic component 27 disposed on the encircled frame component 212*b* of the side frame 212. The annular elastic component 27 is, for example, a silica gel ring. Therefore, it is favorable for keeping a user more comfortable while wearing the mask 2. It is also favorable for providing a sufficient mask attachment.

In this embodiment, the mask 2 comprises a strap 28. The cover shield 211 has two wearing parts 211*f* extending from the convex surface 211*d* towards outside. Each of the two wearing parts 211*f* has a wearing hole 2111. Different two ends of the strap 28 are fastened to the wearing holes 2111 to be fixed to the two wearing parts 211*f*, respectively. In this embodiment, the strap 28 is an elastic belt, but the disclosure is not limited thereto. In some other embodiments, the strap 27 comprises two ring-shaped bands fixed to opposite sides of the cover body 21, respectively.

Figure 7:
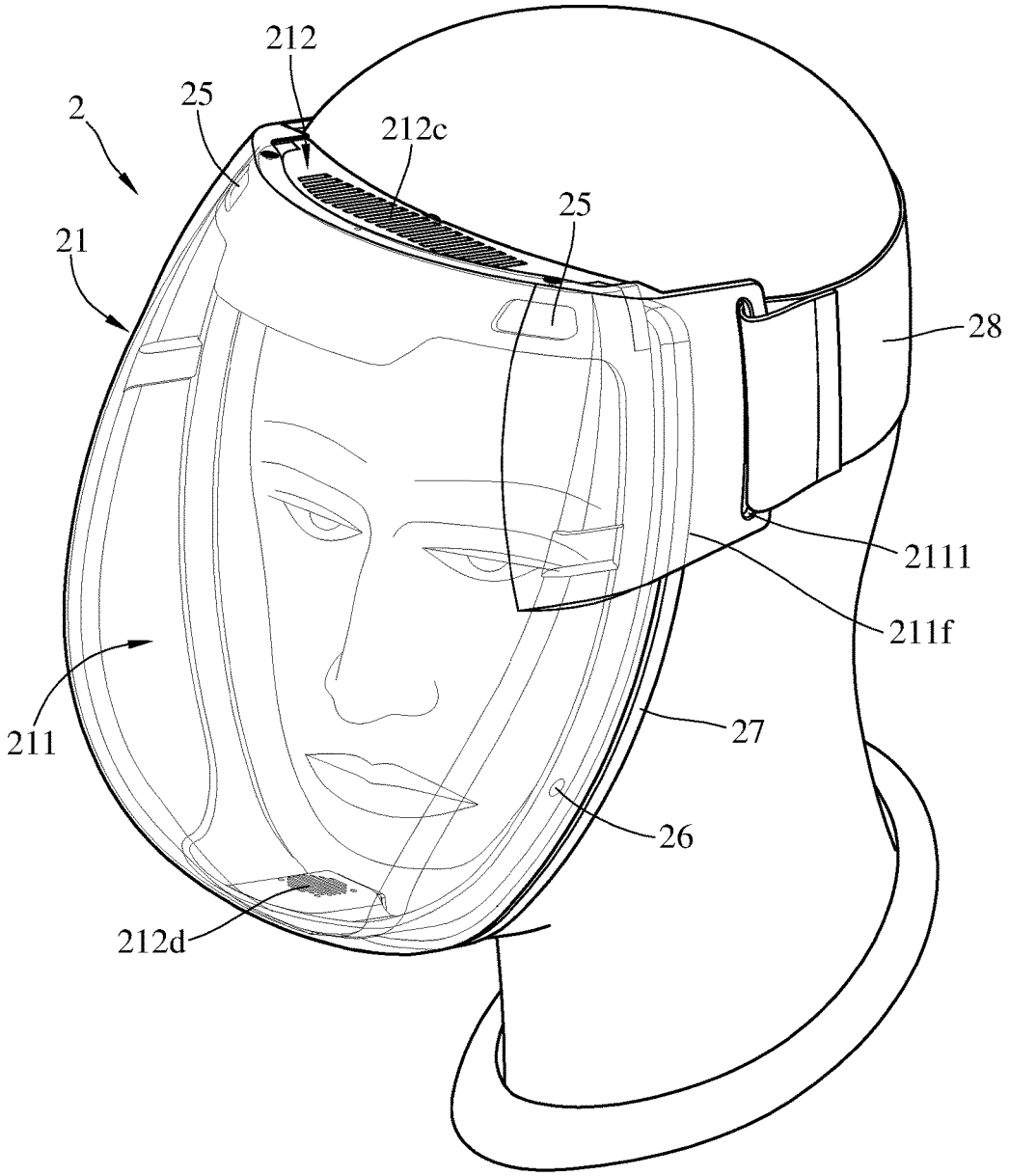
FIG. 7 is a perspective view of the mask worn by a user according to the embodiment of FIG. 1.

The following describes the direction and operation for using the mask after the user wears it. Please refer to FIG. 5, FIG. 6, and FIG. 7. FIG. 7 is a perspective view of the mask worn by a user according to the embodiment of FIG. 1. In this embodiment, when the user wears the mask 2 on his/her face by the strap 28, the face of the user is inside the covering space 211*e* of the cover shield 211. The air inlets 212*c* and the first fans 22 are located at the top of the mask 2 to correspond to the forehead of the user, and the air outlets 211*a*, the air outlets 212*d* and the second fan 23 are located at the bottom of the mask 2 to correspond to the jaw of the user.

After putting the mask 2 on the face, the user turns on a power supply (not shown in the drawings) to drive the first fans 22 and the second fan 23 to operate. Since the first fans 22 increase the speed of an air-flow, the air-flow is able to rapidly flow from the atmosphere into the covering space 211*e* through the air inlets 212*c*. When the air-flow passes through the air inlets 212*c*, the air filter 24 removes the particulates and the harmful substances in the air-flow. After inhaling the air existing in the covering space 211*e*, the user exhales a respiratory gas such as carbon dioxide. The respiratory gas is able to rapidly flow from the covering space 211*e* to the atmosphere through the air outlets 211*a* and the air outlets 212*d*. Therefore, the user is able to breath comfortably with clean air.

Furthermore, the concave surface 211*c* of the cover body 211 faces towards the user. Therefore, the concave surface 211*c* is for reducing a local resistance of the air-flow located in the covering space 211*e* so that most of the air-flow is a laminar flow (in other words, less turbulent flow in the covering space 211*e*), whereby it is favorable for further increasing the speed of the air-flow located in the covering space 211*e*.

Furthermore, the air inlets 212*c* and the first fans 22 are located at the top of the mask 2 to correspond to the forehead of the user. The air outlets 211*a*, the air outlets 212*d* and the second fan 23 are located at the bottom of the mask 2 to correspond to the jaw of the user. Therefore, the air existing in the covering space 211*e* flows from the top of the cover body (the forehead) to the bottom of the cover body 21 (the jaw) so that the respiratory gas is able to rapidly pass through the air outlets 211*a* and the air outlets 212*d* instead of passing through the air inlets 212*c*, whereby it is favorable for preventing the mask 2 from fogging.

Moreover, the first fans 22 and the second fan 23 provide a positive pressure relative to the atmosphere in the covering space 211*e*. Therefore, it is favorable for avoiding polluted air-flowing into the covering space 211*e* from a gap between the face of the user and the mask 2. The user is able to adjust the angle of the deflectors to control the direction of the air-flow flowing into the covering space 211*e*.

When in a smoggy area, the user can turn on a power supply (not shown in the drawings) to drive the first light source 25 and the second light source 26. The first light source 25 illuminates the outside of the mask 2, and the cover shield 211 is made of light-transmissive material. Therefore, it is favorable for increasing a visual distance for the user to be able to see for a greater distance. The second light source 26 illuminates the covering space 211*e*, and the cover shield 211 is made of light-transmissive material. Therefore, other people can see and identify the user in the smog.

According to the disclosure, a first fan of a mask drives an air-flow to rapidly flow from the atmosphere into the mask through the air inlets and an air filter. The air filter removes the particulates and the harmful substances in the air-flow. After inhaling the air existing in the mask, the user exhales a respiratory gas. A second fan of the mask drives the respiratory gas to rapidly flow from the mask to the atmosphere through the air outlets. Therefore, the user is able to breathe comfortably with non-particulate and clean air.

Furthermore, the air inlets and the first fan are located at a top of the mask, and the air outlets and the second fan are located at a bottom of the mask. Therefore, the air existing in the mask flows from the top of the mask to the bottom of mask so that the respiratory gas is able to rapidly pass through the air outlets instead of passing through the air inlets, whereby it is favorable for preventing the mask 2 from fogging.

Moreover, a first light source of the mask illuminates the outside of the mask so that it is favorable for increasing a visual distance for the user to be able to see for a greater distance. A second light source of the mask shines towards the inside of the mask so that other people can see and identify the user in the smog.

In addition, an annular elastic component of the mask is favorable for keeping the user more comfortable while wearing the mask. It is also favorable for providing a sufficient mask attachment.

What is claimed is:

1. A mask, comprising:

a cover body having a top surface, at least one air inlet and at least one air outlet, wherein both of the at least one air inlet and the at least one air outlet penetrate through the cover body, the at least one air inlet is located at a top of the cover body, and the at least one air outlet is located at a bottom of the cover body;

at least one first fan disposed on the cover body, wherein the at least one first fan corresponds to the at least one air inlet;

at least one second fan disposed on the cover body, wherein the at least one second fan corresponds to the at least one air outlet; and an air filter disposed on the cover body, wherein the air filter partially overlaps the at least one air inlet, wherein an axial direction of the at least one first fan, an axial direction of the at least one second fan and a normal line of the top surface are parallel to one another, wherein the cover body comprises a cover shield and a side frame, the cover shield has a shield edge, a concave surface and a convex surface, the concave surface and the convex surface are located at two sides of the cover shield opposite to each other, the side frame is disposed on the concave surface and is surrounded by the shield edge, the at least one air inlet is formed in the side frame, and the at least one air outlet extends through two sides of the side frame and two sides of the cover shield.

2. The mask according to claim 1, wherein the side frame comprises an assembling component and an encircled frame component, the assembling component is disposed on the encircled frame component, the encircled frame component is disposed on the concave surface and is surrounded by the shield edge, the encircled frame component has at least one first fan notch and at least one second fan notch, the at least one air inlet is connected to the at least one first fan notch, the at least one air outlet is connected to the at least one second fan notch, the at least one first fan is located in the at least one first fan notch, and the at least one second fan is located in the at least one second fan notch.

3. The mask according to claim 2, wherein the assembling component comprises a first splint and a second splint, the assembling component has an accommodation space formed between the first splint and the second splint, the at least one air inlet penetrates through the first splint and the second splint so as to connects the accommodation space and the at least one first fan notch, the air filter is located in the accommodation space, and the second splint is located between the air filter and the at least one first fan.

4. The mask according to claim 3, wherein the assembling component further comprises a covering board, and the assembling component further has an opening, the opening is located between the first splint and the second splint, the opening is connected to the accommodation space, and the covering board covers the opening.

5. The mask according to claim 2, wherein the assembling component comprises at least one protecting case and at least one deflector, the at least one protecting case covers the at least one first fan notch, the at least one air inlet penetrates through the at least one protecting case so as to be connected to the at least one first fan notch, and the at least one deflector is located inside the at least one air inlet of the at least one protecting case.

6. The mask according to claim 1, further comprising a first light source, wherein the side frame includes an extending part extending along the concave surface towards a center of the concave surface, and the first light source is disposed on one side of the extending part close to the concave surface.

7. The mask according to claim 1, further comprising a second light source, wherein the side frame has a frame inner surface close to the concave surface, and the second light source is disposed on the frame inner surface.

8. The mask according to claim 1, further comprising an annular elastic component, wherein the annular elastic component is disposed on the cover body.

* * * * *